US011555492B2

(12) United States Patent
Wu

(10) Patent No.: US 11,555,492 B2
(45) Date of Patent: Jan. 17, 2023

(54) AIR COMPRESSION PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 29 days.

(21) Appl. No.: 17/197,344

(22) Filed: Mar. 10, 2021

(65) Prior Publication Data

US 2022/0034312 A1 Feb. 3, 2022

(30) Foreign Application Priority Data

Aug. 3, 2020 (TW) ..... 109209975

(51) Int. Cl.

| | |
|---|---|
| ***F04B 49/24*** | (2006.01) |
| ***F04B 39/12*** | (2006.01) |
| ***F04B 33/00*** | (2006.01) |
| ***F04B 49/035*** | (2006.01) |

(52) U.S. Cl.

CPC ..... *F04B 49/24* (2013.01); *F04B 33/00* (2013.01); *F04B 39/12* (2013.01); *F04B 49/035* (2013.01)

(58) Field of Classification Search

CPC .... F04B 33/005; F04B 25/02; F04B 39/0016; F04B 27/0891; F04B 49/035; F04B 49/24; F04B 33/00; F04B 39/12; F05B 2240/123

See application file for complete search history.

(56) References Cited

U.S. PATENT DOCUMENTS

| | | | | | |
|---|---|---|---|---|---|
| 1,162,222 | A * | 11/1915 | Clawson | F04B 49/24 | 417/311 |
| 1,351,847 | A * | 9/1920 | Gerhart | F04B 33/005 | 417/555.1 |
| 5,676,529 | A * | 10/1997 | Hermansen | F04B 33/005 | 417/259 |
| 5,779,457 | A * | 7/1998 | Chuang | F04B 33/005 | 417/469 |
| 6,027,316 | A * | 2/2000 | Wang | F04B 25/02 | 137/538 |
| 10,815,981 | B2 * | 10/2020 | Wu | F04B 39/10 | |
| 11,333,138 | B2 * | 5/2022 | Wu | F04B 27/005 | |
| 2005/0191193 | A1 * | 9/2005 | Chou | F04B 35/04 | 417/415 |

FOREIGN PATENT DOCUMENTS

| | | | |
|---|---|---|---|
| FR | 322993 A | * | 2/1903 |
| TW | I645111 B | | 12/2018 |

* cited by examiner

*Primary Examiner* — Nathan C Zollinger

(74) *Attorney, Agent, or Firm* — Alan D. Kamrath; Karin L. Williams; Mayer & Williams PC

(57) ABSTRACT

An air compression pump includes a pump head and a pumping device fluidly connected with the pump head. The pumping device includes a cylinder fixed to the pump head. Further, a relief valve is fluidly connected with and received by the pump head. The relief valve defines a relief hole which is fluidly communicable with the first cylinder. The relief valve includes a valve body selectively closing the relief hole. The valve body is movable to an open position to relieve pressure in the air compression pump by allowing pressurized air to flow out of the air compression pump through the relief hole.

13 Claims, 4 Drawing Sheets

AIR COMPRESSION PUMP

BACKGROUND OF THE INVENTION

1. Field of the Invention

The present invention relates to an air compression pump and, particularly, to an air compression pump which is adapted to compress air and discharge air when air pressure in an object to be inflated is higher than a predetermined value quickly and easily.

2. Description of the Related Art

TW Pat. No. 1645111 discloses a variable-pressure air pump, which includes a first cylinder, a second cylinder, a first air pipe, a piston set, a connecting device, and a discharging device. The first cylinder, the second cylinder and the first air pipe are arranged coaxially and can move relative to one another in an axial direction. The piston set can compress the air in the first cylinder and selectively compress the air in the second cylinder. Thus, the air pump can have different pumping modes which supplies air at different pressures. The connecting device is disposed in the first cylinder and suitable for connecting an object to be inflated. The discharging device includes a connecting member and a switch. The connecting member is connected to the second cylinder and has a discharge hole communicating with the second cylinder. The switch is connected to the connecting piece and has an air guiding groove that selectively communicates with the discharge hole and the outside. The air pump is convertible between a first mode for outputting high-volume air in which the first and the second cylinders move relative to one another and a second mode for outputting high-pressure air in which the second cylinder does not move relative to the first cylinder to output high-pressure air.

The air pump has some shortcomings. For instance, the air pump has a complex structure and it involves costly manufacture and assembly procedures.

The present invention is, therefore, intended to obviate or at least alleviate the problems encountered in the prior art.

SUMMARY OF THE INVENTION

According to the present invention, an air compression pump includes a pump head and a pumping device fluidly connected with the pump head. The pumping device includes a first cylinder, a second cylinder and a plunger. The first cylinder has a first end connected with the pump head and a second end coupled to a first piston. The first cylinder is inserted in the second cylinder. The second cylinder is movably coupled to the first cylinder such that the first piston moves in the second cylinder in response to movement of the second cylinder with respect to the first cylinder. The second cylinder includes a first end cap and a second end cap respectively coupled to two ends thereof. The first cylinder is inserted through the first end cap. The plunger is inserted in and movably coupled to the first cylinder and has a first end coupled to a second piston and a second end connected with the second end cap. The second piston moves in the first cylinder in response to the movement of the plunger with respect to the first cylinder. The plunger is inserted through the first piston. Further, a relief valve is fluidly connected with and received by the pump head. The relief valve defines a relief hole which is fluidly communicable with the first cylinder. The relief valve includes a valve body selectively closing the relief hole. The valve body is movable to an open position to relieve pressure in the air compression pump by allowing pressurized air to flow out of the air compression pump through the relief hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
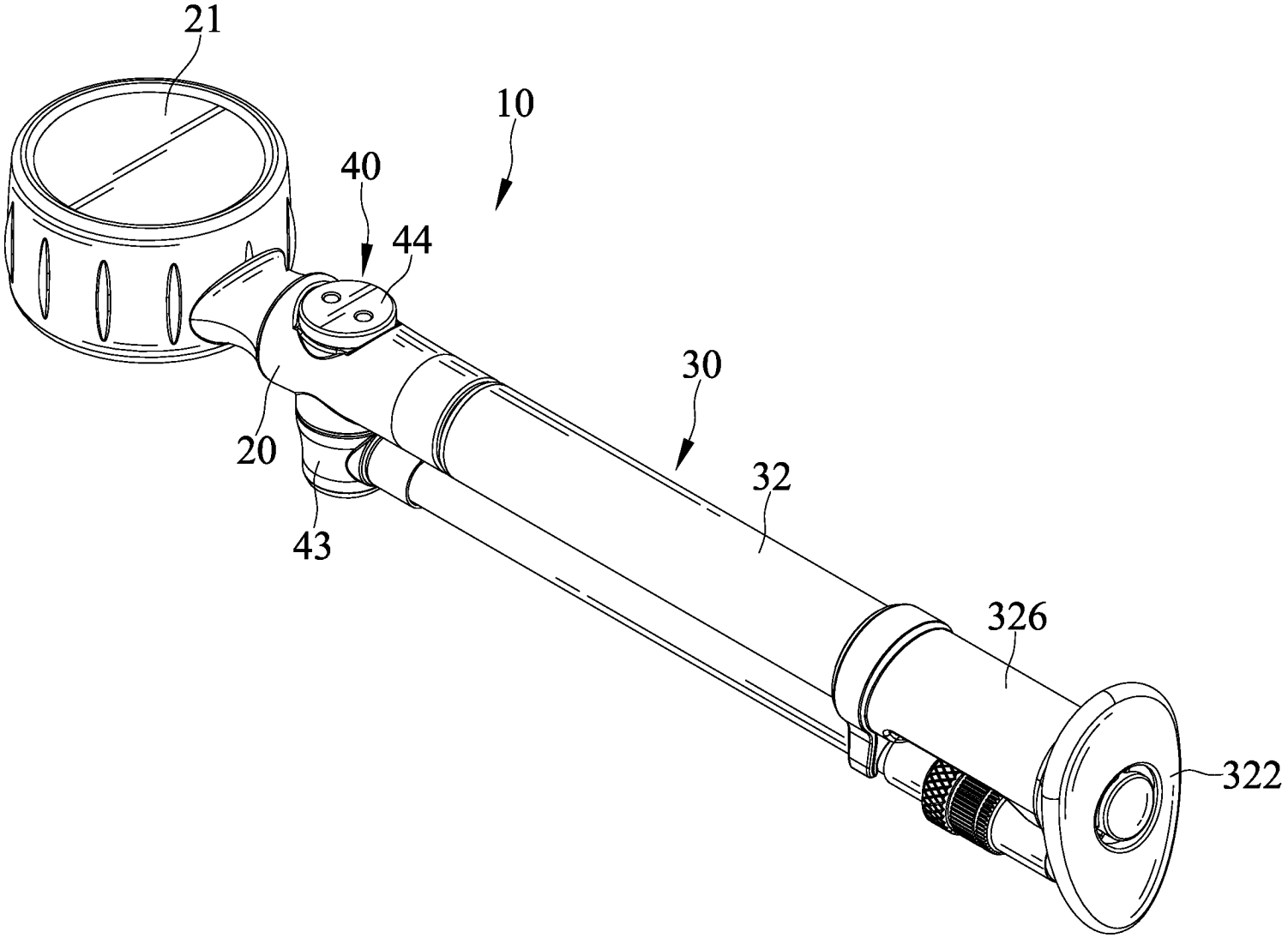
FIG. 1 is a perspective view of an air compression pump in accordance with the present invention.
Figure 2:
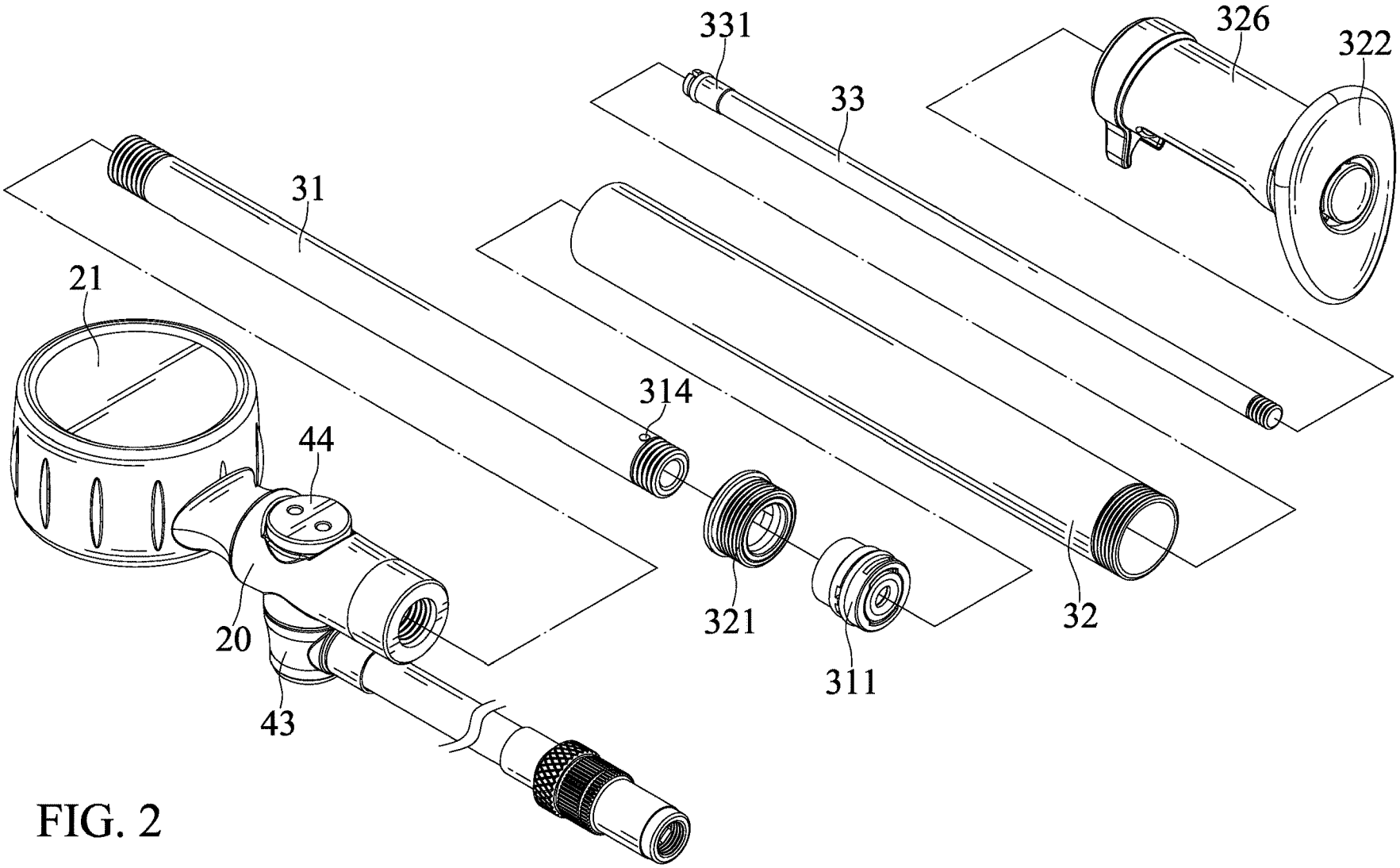
FIG. 2 is an exploded perspective view of the air compression pump of the present invention.
Figure 3:
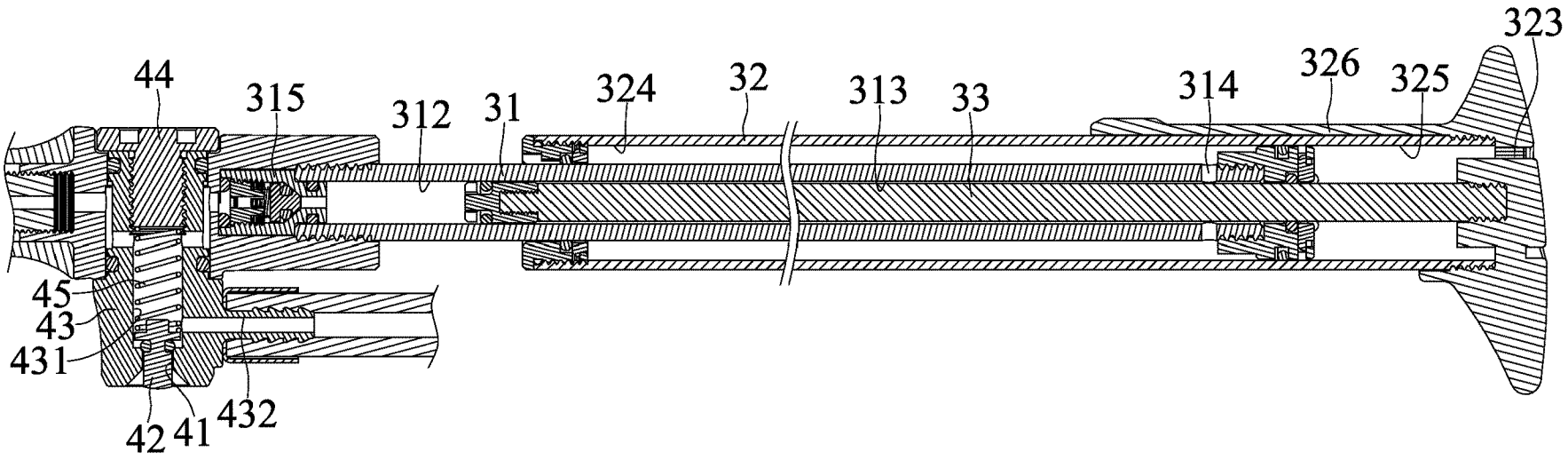
FIG. 3 is a cross-sectional views showing the air compression pump of the present invention stroked to a first position.
Figure 4:
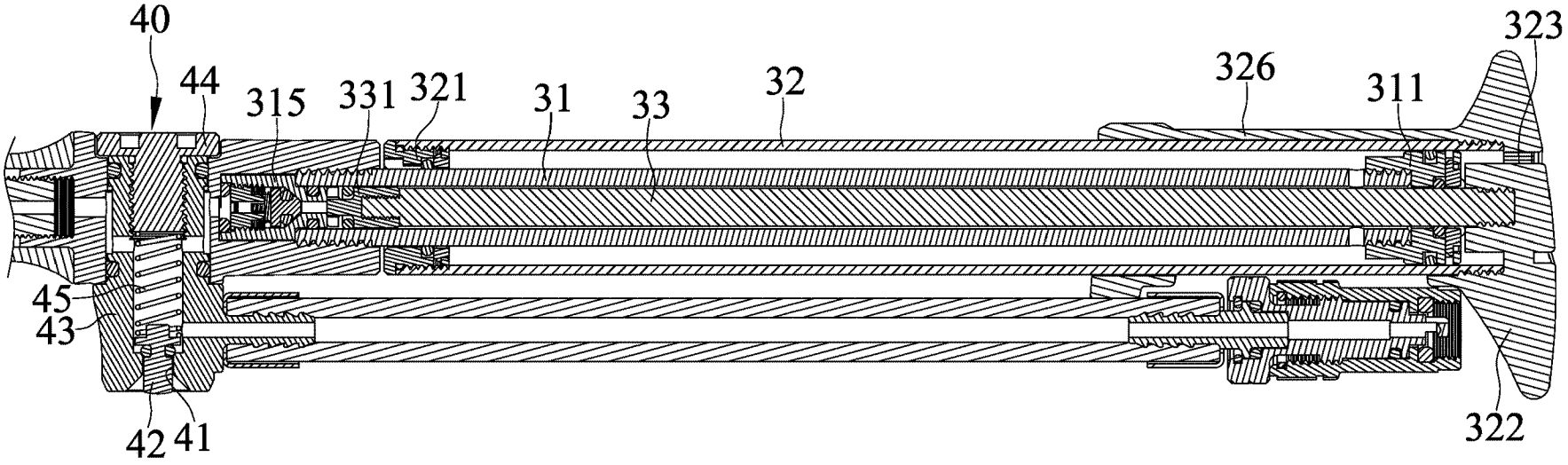
FIG. 4 is a cross-sectional view showing the air compression pump of the present invention stroked to a second position.

FIGS. 1 through 4 show an air compression pump 10 in accordance with the present invention. The air compression pump 10 includes a pump head 20, a pumping device 30, and a relief valve 40.

The pump head 20 is configured to engage with a valve of an object to be inflated by the air compression pump 10.

The pumping device 30 is fluidly connected with the pump head 20. The pumping device 30 is operable and configured to compress air and to pump the air into the object to be inflated. The pumping device 30 is operable manually. The pumping device 30 includes a first cylinder 31, a second cylinder 32, and a plunger 33.

The first cylinder 31 has a first end connected with the pump head 20 and a second end coupled to a first piston 311. The first cylinder 31 is inserted in the second cylinder 32. The first cylinder 31 and the pump head 20 include a non-return valve 315 incorporated therewith such that air is prevented from flowing from the pump head 20 into the first cylinder 31. A pressure gage 21, which is fluidly connected with the pump head 20, is fluidly communicable with the first cylinder 31.

The second cylinder 32 is movably coupled to the first cylinder 31 such that the first piston 311 moves in the second cylinder 32 in response to movement of the second cylinder 32 with respect to the first cylinder 31. Thus, the first piston 311 compresses air in the second cylinder 32. The second cylinder 32 has an outer periphery including a grip 326 disposed thereon that is adapted to be grasped when operating the air compression pump 10, i.e. moving the second cylinder 32 with respect to the first cylinder 31.

Further, the second cylinder 32 includes a first end cap 321 and a second end cap 322 respectively coupled to two ends thereof. The first cylinder 31 is inserted through the first end cap 321. The second end cap 322 defines an orifice 323 allowing air outside the air compression pump 10 to flow into the second cylinder 32 or vice versa. The orifice 323 opens to outside of the air compression pump 10 and the second cylinder 32.

Further, the second cylinder 32 includes a first interior section 324 and a second interior section 325. The first interior section 324 extends between the first end cap 321 and the first piston 311. The second interior section 325 extends between the second end cap 322 and the first piston 311. The first interior section 324 is fluidly communicable with the second interior section 325 such that when the second cylinder 32 is stroked in a first direction away from the first cylinder 31, air outside the air compression pump 10 is drawn into the first interior section 324 through the first end cap 321 and into the first cylinder 31 and such that when the second cylinder 32 is stroked in a second direction opposite to the first direction, pressurized air is urged from the second interior section 325 into the first interior section 324. Specifically, the first cylinder 31 includes a hole 314 extending therethrough radially and opening to the first interior section 324 and the first cylinder 31, thereby allowing air to flow from the first interior section 324 into the first cylinder 31.

The plunger 33 is configured to compress air in the first cylinder 31. The plunger 33 is inserted in and movably coupled to the first cylinder 31. The plunger 33 is inserted through the first piston 311. The plunger 33 moves relative to the first cylinder 31 in response to movement of the second cylinder 32 with respect to the first cylinder 31. Thus, the plunger 33 and the second cylinder 32 move reciprocally together axially with respect to the first cylinder 31 upon the operation of the air compression pump 10.

Further, the plunger 33 has a first end coupled to a second piston 331 and a second end connected with the second end cap 322. The second piston 331 moves in the first cylinder 31 in response to the movement of the plunger 33 with respect to the first cylinder 31.

Additionally, the first cylinder 31 includes a third interior section 312 extending between a first end of the first cylinder 31 and the second piston 331 and a fourth interior section 313 extending between the second piston 331 and a second end of the first cylinder 31. Moreover, the third interior section 312 extends between the non-return valve 315 and the second piston 331. The third interior section 312 is fluidly communicable with the fourth interior section 313 such that when the second cylinder 32 is stroked in the first direction, the pressurized air is urged from the third interior section 312 into the fourth interior section 313 and such that when the second cylinder 32 is stroked in the second direction, the pressurized air is urged from the fourth interior section 313 into the pump head 20.

The relief valve 40 is fluidly connected with and received by the pump head 20. The relief valve 40 defines a relief hole 41 which is fluidly communicable with the first cylinder 31. The relief valve 40 includes a valve body 42 selectively closing the relief hole 41. The valve body 42 is movable to an open position to relieve pressure in the air compression pump 10 by allowing pressurized air to flow out of the air compression pump 10 through the relief hole 41. The valve body 42 includes an end protruding through the relief hole 41.

The relief valve 40 includes a valve seat 43 and the valve body 42 is disposed on the valve seat 43. The valve seat 43 defines a room 431 and the first cylinder 31 and the relief hole 41 are fluidly interconnected by the room 431. The valve body 42 is disposed in the room 431 and urged by a resilient member 45. The valve seat 43 defines a passage 432 configured for allowing the air compression pump 10 to pump the pressurized air into an object to be inflated upon the operation of the air compression pump 10. The passage 432 extends away from the room 431 and is fluidly communicable with the room 431 and the first cylinder 31. The passage 432 extends transversely to the room 431.

The relief valve 40 includes a plug 44 and the resilient member 45 is sustained between the valve body 42 and the plug 44, with the resilient member 45 including one of two ends abutting the valve body 42 and the other of the two ends abutting the plug 44.

In view of the forgoing, the valve body 42 can be moved easily. Therefore, the air compression pump 10 is adapted to discharge air when air pressure in an object to be inflated is higher than a predetermined value quickly and easily. Further, the air compression pump 10 is adapted to compress air easily and quickly by the first and the second pistons 311 and 331.

The foregoing is merely illustrative of the principles of this invention, and various modifications can be made by those skilled in the art without departing from the scope and spirit of the invention.

What is claimed is:

1. An air compression pump comprising:

a pump head;

a pumping device fluidly connected with the pump head, wherein the pumping device includes a first cylinder, a second cylinder and a plunger, wherein the first cylinder has a first end connected with the pump head and a second end coupled to a first piston, wherein the first cylinder is inserted in the second cylinder, wherein the second cylinder is movably coupled to the first cylinder such that the first piston moves in the second cylinder in response to movement of the second cylinder with respect to the first cylinder, wherein the second cylinder includes a first end cap and a second end cap respectively coupled to two ends thereof, wherein the first cylinder is inserted through the first end cap, wherein the plunger is inserted in and movably coupled to the first cylinder and has a first end coupled to a second piston and a second end connected with the second end cap, wherein the second piston moves in the first cylinder in response to the movement of the plunger with respect to the first cylinder, and wherein the plunger is inserted through the first piston; and a relief valve fluidly connected with and received by the pump head, wherein the relief valve defines a relief hole which is fluidly communicable with the first cylinder, wherein the relief valve includes a valve body selectively closing the relief hole, and wherein the valve body is movable to an open position to relieve pressure in the air compression pump by allowing pressurized air to flow out of the air compression pump through the relief hole, wherein the second cylinder includes a first interior section extending between the first end cap and the first piston and a second interior section extending between the second end cap and the first piston, and wherein the first interior section is fluidly communicable with the second interior section such that when the second cylinder is stroked in a first direction away from the first cylinder, air outside the air compression pump is drawn into the first interior section through the first end cap and into the first cylinder and such that when the second cylinder is stroked in a second direction opposite to the first direction, the pressurized air is urged from the second interior section into the first interior section.

2. The air compression pump as claimed in claim 1, wherein the second end cap defines an orifice allowing air outside the air compression pump to flow into the second cylinder or vice versa.

3. The air compression pump as claimed in claim 1, wherein the plunger moves relative to the first cylinder in response to movement of the second cylinder with respect to the first cylinder.

4. The air compression pump as claimed in claim 1, wherein the first cylinder includes a hole extending therethrough radially and opening to the first interior section and the first cylinder, thereby allowing air to flow from the first interior section into the first cylinder.

5. The air compression pump as claimed in claim 1, wherein the first cylinder includes a third interior section extending between a first end of the first cylinder and the second piston and a fourth interior section extending between the second piston and a second end of the first cylinder, and wherein the third interior section is fluidly communicable with the fourth interior section such that when the second cylinder is stroked in the first direction, the pressurized air is urged from the third interior section into the fourth interior section and such that when the second cylinder is stroked in the second direction, the pressurized air is urged from the fourth interior section into the pump head.

6. The air compression pump as claimed in claim 5, wherein the pump head and the first cylinder include a non-return valve incorporated therewith such that air is prevented from flowing from the pump head into the first cylinder, and wherein the third interior section extends between the non-return valve and the second piston.

7. The air compression pump as claimed in claim 1, wherein the relief valve includes a valve seat and the valve body is disposed on the valve seat, wherein the valve seat defines a room and the first cylinder and the relief hole are fluidly interconnected by the room, wherein the valve body is disposed in the room and urged by a resilient member, and wherein the relief valve includes a plug and the resilient member is sustained between the valve body and the plug, with the resilient member including one of two ends abutting the valve body and the other of the two ends abutting the plug.

8. The air compression pump as claimed in claim 7, wherein the valve body includes an end protruding through the relief hole.

9. The air compression pump as claimed in claim 7, wherein the valve seat defines a passage configured for allowing the air compression pump to pump the pressurized air into an object to be inflated upon the operation of the air compression pump, and wherein the passage extends away from the room and is fluidly communicable with the room and the first cylinder.

10. The air compression pump as claimed in claim 9, wherein the passage extends transversely to the room.

11. The air compression pump as claimed in claim 1, wherein the second cylinder has an outer periphery including a grip disposed thereon adapted to be grasped when operating the air compression pump.

12. The air compression pump as claimed in claim 1, wherein the second cylinder and the plunger are moved reciprocally axially with respect to the first cylinder upon the operation of the air compression pump.

13. The air compression pump as claimed in claim 1, further comprising a pressure gage fluidly connected with the pump head and fluidly communicable with the first cylinder.

* * * * *